US010152024B2

(12) United States Patent
Baebler et al.

(10) Patent No.: US 10,152,024 B2
(45) Date of Patent: Dec. 11, 2018

(54) SETTING CROWN FOR TIMEPIECES

(71) Applicant: Meco S.A., Grenchen (CH)

(72) Inventors: Jean Baebler, Gumligen (CH); Christian Olvaszto, Grenchen (CH); Simon Waeckerlin, Grenchen (CH)

(73) Assignee: Meco S.A., Grenchen (CH)

( * ) Notice: Subject to any disclaimer, the term of this patent is extended or adjusted under 35 U.S.C. 154(b) by 0 days.

(21) Appl. No.: 15/666,979

(22) Filed: Aug. 2, 2017

(65) Prior Publication Data

US 2018/0059620 A1 Mar. 1, 2018

(30) Foreign Application Priority Data

Aug. 26, 2016 (EP) ..... 16185951

(51) Int. Cl.
*G04B 37/10* (2006.01)
*G04B 3/04* (2006.01)

(52) U.S. Cl.
CPC ..... *G04B 37/103* (2013.01); *G04B 3/041* (2013.01); *G04B 37/10* (2013.01)

(58) Field of Classification Search
CPC ..... G04B 37/103; G04B 3/041; G04B 37/10; G04B 3/001; G04B 3/046; G04B 3/048; G04B 37/106; G04B 27/002; G04B 27/02
USPC ..... 368/319, 308, 320–321
See application file for complete search history.

(56) References Cited

U.S. PATENT DOCUMENTS

RE24,021 E * 6/1955 Watcher ..... G04B 37/225 224/170
3,376,701 A * 4/1968 Denley ..... G04B 37/10 368/289
3,499,281 A * 3/1970 Denley ..... G04B 37/10 368/289
6,200,020 B1 * 3/2001 Rieben ..... G04B 37/10 368/290
9,317,014 B2 * 4/2016 Briswalter ..... G04B 3/04
9,952,558 B2 * 4/2018 Ely ..... G04B 37/106
2014/0071797 A1 3/2014 Knuchel et al.

FOREIGN PATENT DOCUMENTS

EP 2 366 100 A1 4/2015
EP 2 718 770 A1 4/2016
WO WO 2012/168243 A1 12/2012

OTHER PUBLICATIONS

European Search Report dated Mar. 21, 2017 in European application 1618591.7 , filed on Aug. 26, 2016 (with English Translation of Categories of Cited Documents).

* cited by examiner

*Primary Examiner* — Edwin A. Leon
(74) *Attorney, Agent, or Firm* — Oblon, McClelland, Maier & Neustadt, L.L.P.

(57) ABSTRACT

A crown for timepieces which has improved sealing regardless of its position. To achieve this, the crown includes a tube; a cap including a cover and an axial skirt; a sealing gasket disposed between the screwed or pressed-in tube and the axial skirt of the cap; a pipe fixed to the cap, the pipe and the cap forming an assembly able to be placed in different axial positions relative to the screwed or pressed-in tube; wherein the crown further includes a guide ring integral with one end of the screwed or pressed-in tube, the guide ring including a bearing surface arranged to exert an axial pressure on the sealing gasket in one of the axial positions of the cap.

12 Claims, 2 Drawing Sheets

SETTING CROWN FOR TIMEPIECES

This application claims priority from European Patent Application No. 16185951.7 filed on Aug. 26, 2016, the entire disclosure of which is hereby incorporated herein by reference.

FIELD OF THE INVENTION

The present invention concerns a crown for timepieces.

PRIOR ART

Crowns are currently used in the field of horology to ensure various functions, such as, for example, winding the mainspring of the watch, setting the time or the date. Crowns include, in particular, screw-in crowns, which, in an unscrewed position, can take various axial positions, with each axial position permitting an adjustment mode, and in the screwed-in position ensures reinforced sealing of the timepiece.

A screw-in crown generally includes:

- a tube intended to be screwed or pressed into a watch case. The tube includes a thread arranged in the portion projecting outside the watch case;
- a cap comprising a cover and an axial skirt;
- a central pipe integral with the cap. The central pipe includes a thread intended to be screwed onto the thread of the tube;
- a piston housed inside the central pipe. The piston is capable of engaging with a control stem. The central pipe is arranged to slide over the piston;
- a spring that is axially compressed between the cap and the piston.

The cap can generally be placed in three axial positions:

- a first axial position, called the "screwed-in" position, in which the thread of the central pipe is screwed into the thread of the tube. The first position is used when the user does not need to operate the crown:
- a second axial position, called the "unscrewed but not pulled-out" position, in which the thread of the central pipe is no longer engaged in the thread of the tube. This position is generally used when the user wishes to wind the mainspring using the setting crown. The user then unscrews the cap, which, under the action of the spring places the piston and control stem in mesh;
- a third axial position, called the "unscrewed and pulled-out" position in which the thread of the central pipe is not engaged in the thread of the tube and in which, moreover, the cap is pulled out relative to the unscrewed but not pulled-out position, which places the control stem in a second active position. The second active position, for example, makes it possible to perform an adjustment, such as setting the time of the watch.

To ensure the sealing of the crown, a sealing gasket is disposed between the axial skirt of the cap and the tube. This sealing gasket is held axially between a spacer integral with the axial skirt of the cap and a ring. In the screwed-in position, the gasket is super compressed by a bulge in the tube so that sealing properties are the best possible when the crown is in the screwed-in position.

However, when the crown is in the unscrewed and pulled-out position, the gasket is not super compressed, so that if the user immerses the watch in water in such conditions of use, there is a risk that a certain amount of water will be able to infiltrate between the pump and the tube, especially when the crown is stressed by a radial force relative to the crown. Further, when the crown is in the unscrewed position, the guide tube guides the cap less effectively.

SUMMARY OF THE INVENTION

It is an object of the invention to overcome the drawbacks of the prior art by proposing a crown having improved sealing, especially when it is in the unscrewed and pulled-out position.

It is also an object of the invention to propose a crown providing improved guiding.

To achieve this, there is proposed, according to a first aspect of the invention, a setting crown for timepieces including:

- a tube;
- a cap comprising a cover and an axial skirt;
- a sealing gasket disposed between the screwed or pressed-in tube and the axial skirt of the cap;
- a pipe fixed to the cap, the pipe and the cap forming an assembly able to be placed in different axial positions relative to the screwed or pressed-in tube;
- a guide ring integral with one end of the screwed or pressed-in tube, the guide ring comprising a bearing surface arranged to exert an axial pressure on the sealing gasket in one of the axial positions of the pipe/cap assembly.

The setting crown may also have one or more of the following features, taken independently or in all technically possible combinations.

Advantageously, the crown further comprises a retaining ring integral with the cap, the sealing gasket being compressed between the guide ring and the retaining ring in at least one axial position.

Advantageously, the cap/pipe assembly can be placed in at least two axial positions relative to the screwed or pressed-in tube:

- a first axial position in which the cap cover is located at a first distance from the guide ring. The guide ring is preferably resting against an inner surface of the cover in this first axial position.
- a second axial position in which the cap cover is located at a second distance from the guide ring, the second distance being greater than the first distance. The bearing surface preferably exerts a pressure on the sealing gasket in this second axial position.

Advantageously, the bearing surface is oblique such that compression of the sealing gasket by the guide ring is optimum.

Advantageously, the bearing surface is disposed in the continuity of an outer surface of the screwed or pressed-in tube, the bearing surface and the outer surface of the screwed or pressed-in tube forming an obtuse angle, which makes it possible for the bearing surface to avoid damaging the sealing gasket when it compresses the latter.

Advantageously, the crown further includes a spacer disposed inside the axial skirt of the cap, the guide ring including a lateral surface arranged to slide against the spacer, which makes it possible for the guide ring to better guide the cap.

Advantageously, the coefficient of friction between the lateral surface of the guide ring and the spacer is less than or equal to 0.2.

According to different embodiments:

- the guide ring may be made of a filled or non-filled thermoplastic or composite material;
- the guide ring may be made of ceramic;

the guide ring may be made of metal.

Advantageously, the guide ring is pressed onto the end of the screwed or pressed-in tube.

Advantageously, the guide ring includes a transverse surface arranged to move into abutment against a transverse shoulder of the central pipe when the cap is screwed onto the screwed or pressed-in tube.

Advantageously, the screwed or pressed-in tube includes a guide conduit able to move into abutment against a guide surface of the pipe over a residual length comprised between 0.2 mm and 1.5 mm, and preferably between 0.2 mm and 1.0 mm, when the crown is in the unscrewed and pulled-out position. Thus, the contact length between the pipe and the screwed or pressed-in tube is never less than this residual length, which makes it possible to avoid lateral movement between these two components.

A second aspect of the invention concerns a timepiece including a crown according to the first aspect of the invention.

BRIEF DESCRIPTION OF THE DRAWINGS

Other features and advantages of the present invention will appear more clearly from the following detailed description of preferred embodiments, given by way of non-limiting example, with reference to the annexed Figures, in which.

DETAILED DESCRIPTION

Figure 3:
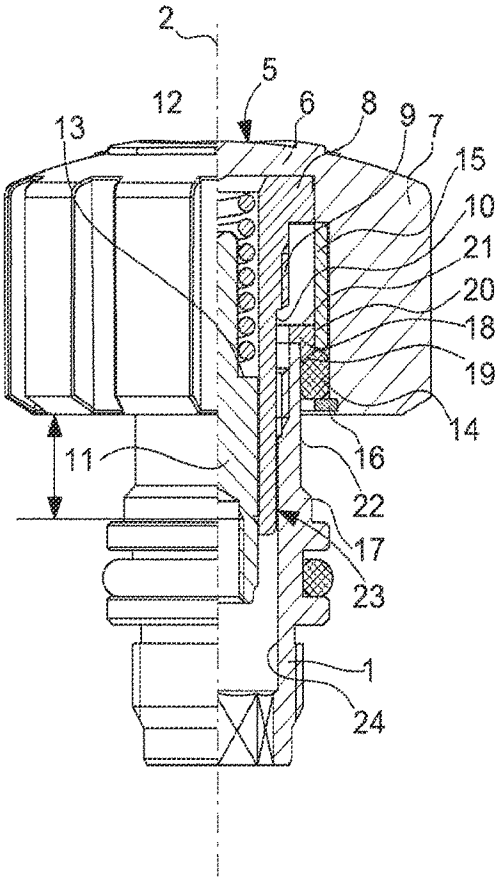
FIG. 3 is a semi-cross-sectional view of the crown of FIG. 1 in the unscrewed and pulled-out position.

There will now be described a crown according to a first embodiment with reference to FIGS. 1 to 3.

The crown comprises a tube 1 intended to be secured on a watch case (not represented) by being screwed or pressed into the middle part of the watch case. In the example represented, tube 1 is screwed onto the case middle. Tube 1 has a symmetry of revolution relative to a reference axis 2. Tube 1 includes a thread 3. In this embodiment, thread 3 is disposed on an inner wall 4 of tube 1.

The crown also includes a cap 5. Cap 5 includes a cover 6 and an axial skirt 7. The axial skirt has a symmetry of revolution about reference axis 2. Cover 6 and axial skirt 7 define a cavity. The crown also includes a pipe 8 inserted inside the cavity in cap 5. Pipe 8 is preferably integral with cap 5. Pipe 8 includes a thread 9 arranged to be screwed into thread 3 of tube 1. In this embodiment, thread 9 of pipe 8 is positioned on an outer wall 10 of pipe 8.

The crown can be placed in different positions

Figure 2:
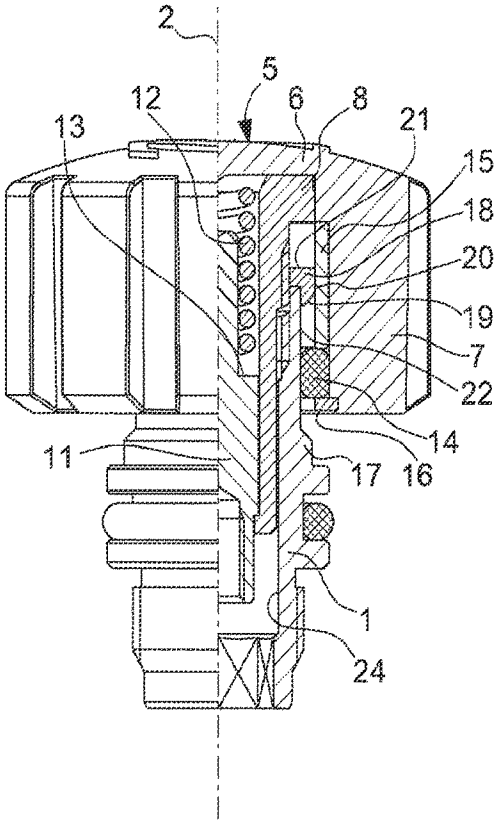
FIG. 2 is a semi-cross-sectional view of the crown of FIG. 1 in the unscrewed but not pulled-out position.
Figure 1:
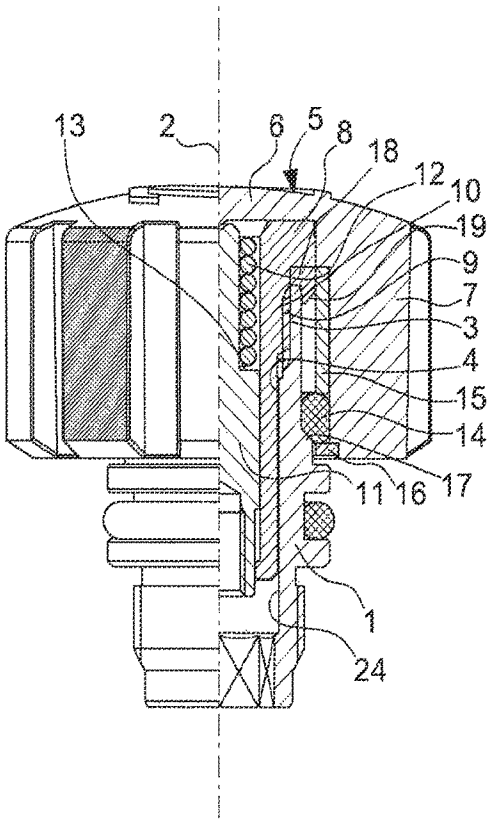
FIG. 1 is a semi cross-sectional view of a crown according to one embodiment of the invention in a screwed-in position.

- a position known as the "screwed-in" position, represented in FIG. 1, in which thread 9 of pipe 8 is screwed into thread 3 of tube 1;
- a position known as the "unscrewed but not pulled-out" position, represented in FIG. 2, in which thread 9 of pipe 8 is not screwed into thread 3 of tube 1, and cap 5 occupies a first axial position relative to tube 1. In this first axial position, cover 6 of cap 5 is separated by a first distance from tube 1;
- a position known as the "unscrewed and pulled-out" position, represented in FIG. 3, in which thread 9 of pipe 8 is not screwed into thread 3 of tube 1, and cap 5 is also pulled-out relative to tube 1, so as to occupy a second axial position relative to tube 1. In this second axial position, cover 6 of cap 5 is separated by a second distance from tube 1, the second distance being greater than the first distance.

In this example embodiment, the crown also includes a piston 11 housed inside a central aperture in pipe 8. The crown also includes a spring 12 disposed inside a cavity defined by the cap/pipe assembly on the one hand and by the piston on the other. Spring 12 is axially compressed between cover 6 of cap 5 and a shoulder 13 of piston 11 and, in particular, allows cap 5 to be moved away from shoulder 13 of piston 11. Piston 11 kinematically connects cap 5 to a control stem (not represented) of the timepiece movement housed inside the watch case. This control stem allows the user to perform different operations according to the axial position of cap 5 relative to tube 1. Thus, the control stem makes it possible to wind the watch when cap 5 is in the unscrewed but not pulled-out position, whereas it allows certain corrections to be made, such as to the time, when cap 5 is in the unscrewed and pulled-out position.

The crown also includes a sealing gasket 14 inserted between axial skirt 7 of cap 5 and tube 1 in order to ensure the sealing of the crown. In the embodiment of FIGS. 1 to 3, sealing gasket 14 is an O ring joint. Sealing gasket 14 is retained axially in this example between a spacer 15, positioned against an inner wall of axial skirt 7 of cap 5, and a retaining ring 16. According to a variant, spacer 15 and/or retaining ring 16 may be integral with axial skirt 7.

When the crown is in the screwed-in position, as represented in FIG. 1, sealing gasket 14 is super compressed by a bulge 17 in tube 1, so that sealing properties of the crown are the best possible when the crown is in the screwed-in position.

The crown further includes a guide ring 18 integral with the end of tube 1 disposed facing cover 6 of cap 5. Ring 18 is preferably pressed onto the end of tube 1. Guide ring 18 may also be bonded or secured in any other manner on tube 1.

Guide ring 18 includes a bearing surface 19 able to exert a pressure on sealing gasket 14 when the crown is in the unscrewed and pulled-out position as represented in FIG. 3. In the unscrewed and pulled-out position, sealing gasket 14 is thus compressed between retaining ring 16, on the one hand, and spacer 15 and guide ring 18, on the other. To achieve this, bearing surface 19 is preferably oblique relative to reference axis 2. In other words, the guide ring is beveled.

Bearing surface 19 is positioned in the continuity of an outer surface 22 of tube 1, with which bearing surface 19 forms an obtuse angle, to avoid damaging sealing gasket 14 when it compresses the latter. Guide ring 18 thus enhances the sealing of the crown in the unscrewed and pulled-out position.

Further, the guide ring includes a lateral surface 20 arranged to slide against spacer 15, which allows guide ring 18 to improve the guiding of cap 5. Indeed, cap 5 is thus guided by lateral surface 20 of guide ring 18 when the cap changes from one axial position to another, which limits its angular displacement.

To achieve this, the coefficient of friction between lateral surface 20 of the guide ring and the spacer is less than or equal to 0.2.

To achieve this, in different embodiments, such as for example:

- when the spacer is made of metal material, for example stainless steel, gold, or titanium, the guide ring may also be selected from the same above mentioned materials.
- when the spacer is made of metal material, for example stainless steel, gold, or titanium, the guide ring may also be made of filled or non-filled thermoplastic or composite material, such as, for example, polyetheretherketone, polyamide, polyoxymethylene, carbon fibre reinforced plastic, etc., whose structure has been modified by treatment, for example by gamma rays, annealing, etc., or is unmodified.
- when the spacer is made of metal material, for example stainless steel, gold, or titanium, the guide ring may be made of ceramic, such as for example, of $ZrO_2$, $Al_2O_3$, $Si_3N_4$, TiC, or a mixture of thereof.
- when the spacer is made of filled or non-filled thermoplastic or composite material, such as for example, polyetheretherketone, polyamide, polyoxymethylene, carbon fibre reinforced plastic, etc., whose structure has been modified by treatment, for example by gamma rays, annealing, etc., or is unmodified, the guide ring may be made of ceramic, such as for example, of $ZrO_2$, $Al_2O_3$, $Si_3N_4$, TiC, or a mixture thereof.

It will be noted that the pairs of materials mentioned for the spacer and the ring can of course be reversed.

Guide ring 18 may also have a transverse surface 21 able to move into abutment against cover 6 of cap 5 when the crown is in the screwed-in position, as represented in FIG. 1.

Further, again in order to improve the guiding of cap 5, tube 1 preferably includes a guide conduit 24 able to move into abutment against a guide surface 23 of pipe 8, over a residual length L, comprised between 0.2 mm and 1.5 mm and preferably between 0.2 mm and 1.0 mm, when the crown is in the unscrewed and pulled-out position (FIG. 3). Thus, the contact length between tube 1 and pipe 8 is never less than this residual length L to optimise the guiding of pipe 8 inside tube 1.

Figure 5:
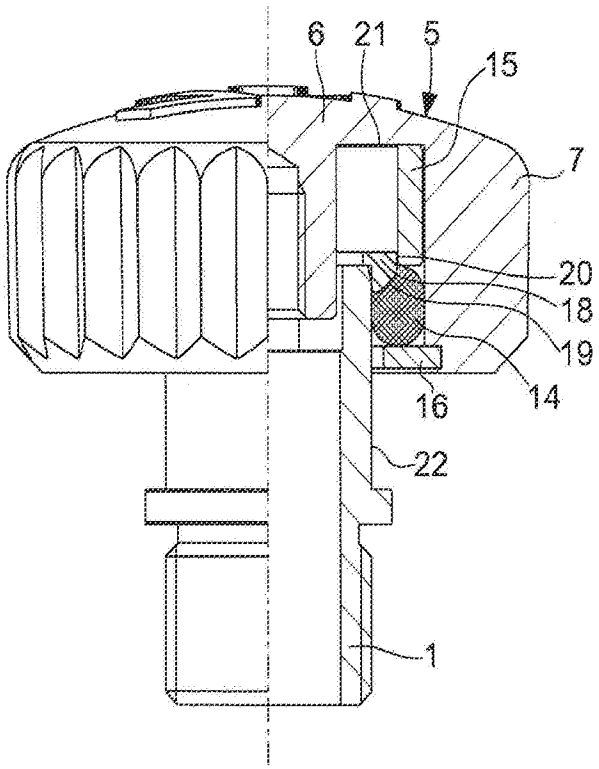
FIG. 5 is a semi-cross-sectional view of the crown of FIG. 4 in a second position.
Figure 4:
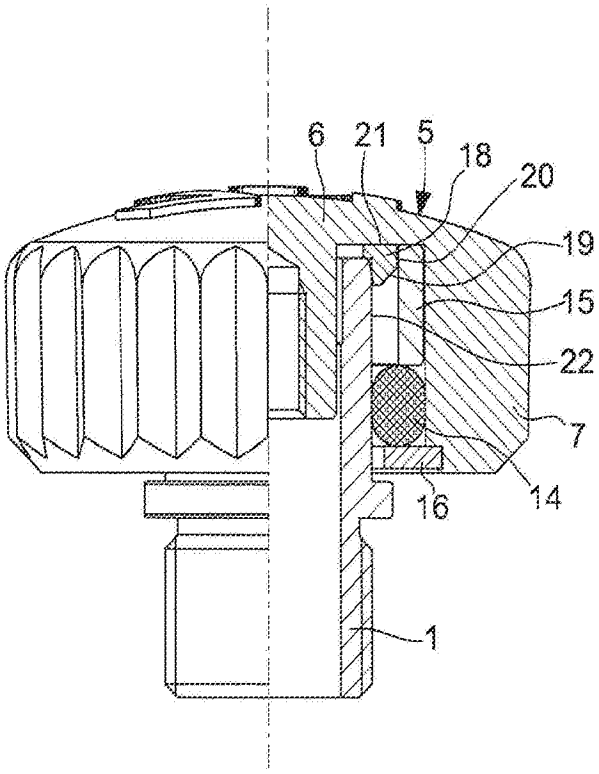
FIG. 4 is a semi-cross-sectional view of a crown according to another embodiment of the invention in a first position.

Naturally, the invention is not limited to the embodiments described with reference to the Figures and variants could be envisaged without departing from the scope of the invention. Thus, FIGS. 4 and 5 represent another embodiment, wherein cap 5 can take only two different axial positions relative to tube 1: a basic position represented in FIG. 4, and a pulled-out position represented in FIG. 5. In the basic position, guide ring 18 is in abutment against cover 6 of cap 5 and the cap is not screwed onto tube 1. In the pulled-out position, bearing surface 19 of guide ring 18 exerts a pressure on sealing gasket 14. Sealing gasket 14 is then compressed between bearing surface 19, spacer 15 and retaining ring 16.

Further, the invention could also be implemented in the case where the crown has no spacer against the inner wall of the axial skirt of the cap. In that case, the lateral surface of the guide ring would be adapted to slide directly against the inner wall of the axial skirt with minimum friction.

It could also be envisaged that the guide ring and the screwed or pressed-in tube form a single integral piece.

It will be noted finally that the invention relates equally to crowns of the type that are screwed onto tube 1, as represented in FIGS. 1 to 3, and to crowns that are not screwed onto tube 1, as represented in FIGS. 4 and 5.

What is claimed is:

1. A setting crown for timepieces comprising:

a tube;

a cap including a cover and an axial skirt;

a sealing gasket disposed between the tube and the axial skirt of the cap;

a pipe fixed to the cap, the pipe and the cap forming an assembly able to be placed in different axial positions relative to the tube; and a guide ring integral with one end of the tube, the guide ring including a bearing surface arranged to exert an axial pressure on the sealing gasket in one of the axial positions of the pipe/cap assembly, when the crown is in a pulled-out position.

2. The crown according to claim 1, wherein the bearing surface is oblique.

3. The crown according to claim 1, wherein the bearing surface is disposed in the continuity of an outer surface of the tube, the bearing surface and the outer surface of the tube forming an obtuse angle.

4. The crown according to claim 1, further comprising a spacer disposed inside the axial skirt of the cap, the guide ring including a lateral surface arranged to slide against the spacer.

5. The crown according to claim 4, wherein the coefficient of friction between the lateral surface of the guide ring and the spacer is less than or equal to 0.2.

6. The crown according to claim 1, wherein the guide ring is made of a thermoplastic material.

7. The crown according to claim 1, wherein the guide ring is made of ceramic.

8. The crown according to claim 1, wherein the guide ring is made of metal.

9. The crown according to claim 1, wherein the guide ring is pressed onto the end of the tube.

10. The crown according to claim 1, wherein the tube includes a guide conduit arranged to move into abutment against a guide surface of the pipe over a residual length comprised between 0.2 mm and 1.5 mm.

11. A timepiece comprising the crown according to claim 1.

12. The crown according to claim 10, wherein the residual length is between 0.2 mm and 1.0 mm.

* * * * *